United States Patent [19]

Myers

[11] Patent Number: 4,913,353

[45] Date of Patent: Apr. 3, 1990

[54] NOZZLE APPARATUS HAVING ANGLED ORIFICE

[75] Inventor: Terrance L. Myers, Columbus, Kans.

[73] Assignee: Ingersoll-Rand Company, Woodcliff Lake, N.J.

[21] Appl. No.: 322,184

[22] Filed: Mar. 13, 1989

[51] Int. Cl.[4] ..... B24C 5/04

[52] U.S. Cl. ..... 239/267; 51/439

[58] Field of Search ..... 51/439, 411, 427, 319–321; 239/267, 268, 504, 521, 518

[56] References Cited

U.S. PATENT DOCUMENTS

| | | | |
|---|---|---|---|
| 1,301,211 | 4/1919 | Abrahamson | 239/587 |
| 2,392,897 | 1/1946 | Archer | 51/439 |
| 2,428,276 | 9/1947 | Griswold | 51/439 |
| 2,594,735 | 4/1952 | Crimley | 51/439 |
| 3,326,607 | 6/1967 | Book | 299/58 |
| 4,478,368 | 10/1984 | Yie | 51/439 |
| 4,528,782 | 7/1985 | Bean | 51/439 |
| 4,696,645 | 9/1987 | Saupe et al. | 433/125 |
| 4,827,680 | 5/1989 | Rushing et al. | 51/321 |

FOREIGN PATENT DOCUMENTS

| | | | |
|---|---|---|---|
| 9873 | 1/1987 | Japan . | |
| 0009874 | 1/1987 | Japan | 51/439 |

*Primary Examiner*—Robert Rose

*Attorney, Agent, or Firm*—James R. Bell

[57] ABSTRACT

A nozzle tube has a centroidal axis extending therethrough from a first end to a second end of the tube. A bore also extends from the first end to the second end. The bore has a first constant diameter portion extending from the first end toward the second and a second variable diameter portion adjacent the second end. The first portion has a centroidal axis skewed from the centroidal axis of the tube. A retainer retains an orifice in the second portion. The retainer has a variable diameter for mating engagement with the variable diameter of the second portion. The retainer has a centroidal axis which intersects the centroidal axis of the tube at a first angle and intersects the centroidal axis of the bore at a second angle, greater than the first angle.

8 Claims, 1 Drawing Sheet

NOZZLE APPARATUS HAVING ANGLED ORIFICE

BACKGROUND OF THE INVENTION

This invention relates generally to abrading machines having a specific nozzle structure and more particularly to a nozzle apparatus having an angled orifice for use with a fluid jet cutting device.

For some special applications, it is sometimes advantageous to have a nozzle wherein the orifice ejects a fluid jet cutting stream at some angle relative to the longitudinal axis of the nozzle. Often this angle is about 45 degrees relative to a central bore formed coincident with the centroidal axis of the nozzle. The orifice is in some instances retained in the nozzle by a setscrew.

In nozzles used in fluid jet cutting devices it is desirable to have the orifice sealingly seated in the nozzle tube by way of a conical seat. However, when the orifice is to be angled relative to the nozzle tube, especially where the nozzle tube is of a relatively small diameter, for example, ⅜ of an inch or less, it is difficult to provide a sufficient conical seat and also provide an adequate angle between the tube and orifice axes. It is also difficult to provide an orifice of sufficient length when angularly seated in a nozzle tube of relatively small diameter. These difficulties are due to the reduced amount of material available to receive the angularly disposed orifice in the smaller diameter tube.

The foregoing illustrates limitations known to exist in present devices. Thus, it is apparent that it would be advantageous to provide an alternative directed to overcoming one or more of the limitations set forth above. Accordingly, a suitable alternative is provided including features more fully described hereinafter.

SUMMARY OF THE INVENTION

In one aspect of the present invention, this is accomplished by providing a nozzle tube having a first and a second end. The tube has a centroidal axis extending therethrough and also has a bore extending therethrough. The bore has a first constant diameter portion extending from the first end toward the second end and a second variable diameter portion adjacent the second end. The first portion has a centroidal axis skewed from the centroidal axis of the tube. A retainer retains an orifice in the second portion. The retainer has a centroidal axis which intersects the centroidal axis of the tube at a first angle and which intersects the centroidal axis of the bore at a second angle, greater than the first angle.

The foregoing and other aspects will become apparent from the following detailed description of the invention when considered in conjunction with the accompanying drawing figures. It is to be expressly understood, however, that the drawing figures are not intended as a definition of the invention but are for the purpose of illustration only.

BRIEF DESCRIPTION OF BE DRAWING FIGURES

DETAILED DESCRIPTION

Figure 1:
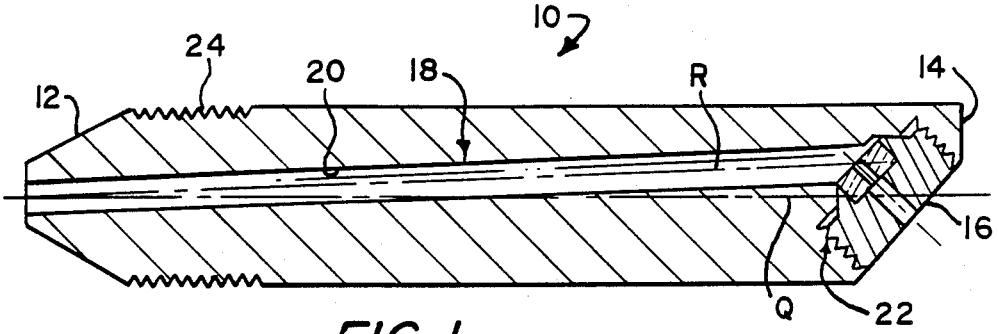
FIG. 1 is a cross-sectional side view illustrating an embodiment of nozzle tube apparatus of the present invention.

A nozzle tube apparatus is generally designated 10 in FIG. 1 and is an elongated tube of a suitable material such as stainless steel. Tube 10 has a first end 12 and a second end 14 including a face 16 angled relative to the tube centroidal axis indicated by the line designated Q. A bore 18 is formed through tube 10 from first end 12 to second end 14 and includes a first constant diameter portion 20 extending from first end 12 toward second end 14, and a second variable diameter recessed portion 22 adjacent second end 14.

First portion 20 of bore 18 has a centroidal axis indicted by the line designated by R. Centroidal axis R is skewed from a centroidal axis Q by the angle designated "a" in FIG. 3.

First end 12 includes a threaded outside diameter portion 24 for attaching nozzle tube 10 to a pneumatic valve by way of a coupling for use in a well-known fluid jet cutting device (not shown).

Figure 2:
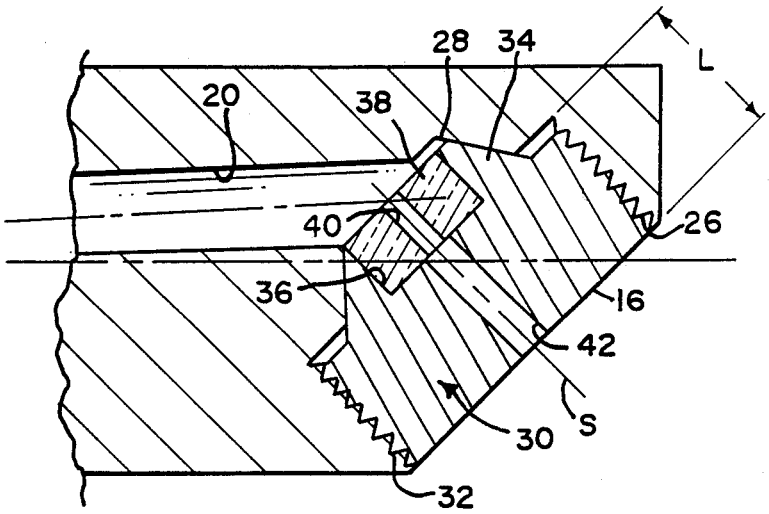
FIG. 2 is an enlarged cross-sectional side view illustrating an embodiment of the combined orifice holder and set screw of the present invention.

Recessed portion 22 includes a threaded recess 26 formed in face 16, FIG. 2. Threaded recess 26 is of a length designated L. Also included in recess 26 is a conical seat portion 28 which interconnects threaded recess 26 and first portion 20 of bore 18.

A retainer means 30 formed of a suitable metal such as stainless steel comprises a combined set screw and orifice holder and has a threaded outer diameter 32 to be received in threaded recess 26. Retainer means 30 also includes a frusto-conical extended portion 34 for mating engagement with conical seat portion 28. Thus, retainer means 30 is of a variable diameter structure in accordance with the variable diameter structure of recessed portion 22.

Figure 3:
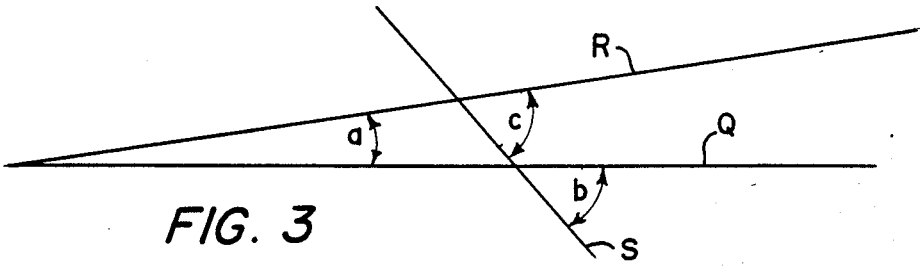
FIG. 3 is a diagrammatic view illustrating angular relationships defined by the structure of FIGS. 1 and 2.

Frusto-conical portion 34 includes a cavity 36 formed therein for receiving a suitable orifice member 38. Such an orifice member 38 may be of sapphire as is well known. Orifice member 38 includes a bore 40 extending therethrough coincident with the centroidal axis thereof. Also, retainer means 30 includes a bore 42 extending therethrough coincident with the centroidal axis thereof. Bores 40, 42 are aligned along common centroidal axes indicated by the line designated S. As illustrated in FIG. 3, axis S intersects axis Q at an angle designated "b", and intersects axis R at an angle designated "c". From the drawing it is apparent that since axis R is skewed from axis Q by angle "a", it follows that angle "c" is greater than angle "b". Also, as illustrated in FIG. 2, providing bore 20 along axis R, skewed relative to axis Q, increases the length L of recess 26. As a result, the amount of material of smaller diameter tube 10 which is available to receive an angularly disposed orifice is maximized by skewing bore 20 relative to the centroidal axis Q of the tube 10.

While this invention has been illustrated and described in accordance with a preferred embodiment, it is recognized that variations and changes may be made therein without departing from the invention as set forth in the claims.

What is claimed is:

1. A nozzle tube apparatus, comprising:

a nozzle tube having a first and a second end, the tube having a centroidal axis extending therethrough and having a bore extending from the first end to the second end, the bore having a first constant diameter portion extending from the first end toward the second end and a second variable diameter recessed portion adjacent the second end, the first portion having a centroidal axis skewed from the centroidal axis of the tube, the first constant diameter portion of the bore being coincident with the centroidal axis of the tube adjacent the first end of the tube;

retainer means for retaining an orifice in the second portion, said retainer means having a variable diameter for mating equipment with the variable diameter of the second portion, the retainer means having a centroidal axis therethrough which intersects the centroidal axis of the tube at a first angle and intersects the centroidal axis of the bore at a second angle, greater than the first angle; and the second portion includes a conical seat.

2. The apparatus of claim 1, wherein the first end of the nozzle tube includes a threaded outside diameter.

3. The apparatus of claim 1, wherein the retainer means includes a frusto-conical extended portion in mating engagement with the conical seat.

4. The apparatus of claim 3, wherein the frusto-conical portion has a cavity formed therein.

5. The apparatus of claim 4, including:

an orifice member seated in the cavity.

6. The apparatus of claim 5, wherein the orifice member and the retainer means each have a bore extending therethrough, the orifice member bore being aligned with the retainer means bore, the aligned bores being coincident with the centroidal axis of the retainer means, the bore of the orifice member having a first diameter and the bore of the retainer means having a second diameter greater than the first diameter.

7. The apparatus of claim 1, wherein the retainer means is a combined set screw and orifice holder threadedly received in the second portion.

8. A nozzle tube apparatus, comprising:

a nozzle tube having a first and a second end, the tube having a centroidal axis extending therethrough and having a bore extending from the first end to the second end, the bore having a first constant diameter portion extending from the first end toward the second end and a second variable diameter recessed portion adjacent the second end, the first portion having a centroidal axis skewed from the centroidal axis of the tube, the centroidal axis of the first portion intersecting the centroidal axis of the tube adjacent the first end of the tube;

retainer means for retaining an orifice in the second portion, said retainer means having a variable diameter for mating engagement with the variable diameter of the second portion, the retainer means having a centroidal axis therethrough which intersects the centroidal axis of the tube at a first angle and intersects the centroidal axis of the bore at a second angle, greater than the first angle; and the second portion includes a conical seat.

* * * * *

UNITED STATES PATENT AND TRADEMARK OFFICE

CERTIFICATE OF CORRECTION

PATENT NO. : 4,913,353

DATED : April 3, 1990

INVENTOR(S) : Terrance L. Myers

It is certified that error appears in the above—identified patent and that said Letters Patent is hereby corrected as shown below:

Column 3, line 15, delete "equipment" and insert--engagement--.

Signed and Sealed this

Ninth Day of April, 1991

*Attest:*

HARRY F. MANBECK, JR.

*Attesting Officer*

*Commissioner of Patents and Trademarks*